US010578360B2

(12) United States Patent
Inami

(10) Patent No.: US 10,578,360 B2
(45) Date of Patent: Mar. 3, 2020

(54) DRYING APPARATUS AND DRYING METHOD USING THE DRYING APPARATUS

(71) Applicant: SUBARU CORPORATION, Tokyo (JP)

(72) Inventor: Akiko Inami, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 91 days.

(21) Appl. No.: 15/949,877

(22) Filed: Apr. 10, 2018

(65) Prior Publication Data

US 2018/0328663 A1 Nov. 15, 2018

(30) Foreign Application Priority Data

May 15, 2017 (JP) ..... 2017-096157

(51) Int. Cl.

| | |
|---|---|
| ***F26B 15/18*** | (2006.01) |
| ***F26B 23/10*** | (2006.01) |
| ***F26B 25/16*** | (2006.01) |
| ***F26B 25/00*** | (2006.01) |
| ***F26B 15/14*** | (2006.01) |
| ***F26B 21/10*** | (2006.01) |
| ***F26B 3/04*** | (2006.01) |
| ***F26B 21/04*** | (2006.01) |

(52) U.S. Cl.

CPC ..... *F26B 15/18* (2013.01); *F26B 3/04* (2013.01); *F26B 15/14* (2013.01); *F26B 21/04* (2013.01); *F26B 21/10* (2013.01); *F26B 23/10* (2013.01); *F26B 25/005* (2013.01); *F26B 25/006* (2013.01); *F26B 25/16* (2013.01); *F26B 2210/12* (2013.01)

(58) Field of Classification Search

CPC ..... F26B 15/18; F26B 23/10; F26B 25/005; F26B 25/16; F26B 2210/12

USPC ..... 34/282

See application file for complete search history.

(56) References Cited

U.S. PATENT DOCUMENTS 4,136,463 A * 1/1979 Nolan ..... F26B 3/28 118/58

4,761,894 A * 8/1988 Hamasaki ..... F26B 3/305 118/58

(Continued)

FOREIGN PATENT DOCUMENTS

CN 202254674 U 5/2012

CN 204460951 U 7/2015

(Continued)

OTHER PUBLICATIONS

JPO Decision to Grant a Patent in JPA No. 2017-096157, dated Jan. 22, 2019 (English translation available on Dossier System).

*Primary Examiner* — Stephen M Gravini

(74) *Attorney, Agent, or Firm* — McGinn IP Law Group, PLLC

(57) ABSTRACT

A drying apparatus includes a heating mechanism configured to heat an inside of a drying oven in which paint applied to a workpiece is dried. The inside of the drying oven is partitioned into an upper region and a lower region by a partition plate. The drying oven has an air passage that enables air to flow between the upper region and the lower region. A metal member to which paint is applied is conveyed into the upper region, and a resin member to which paint is applied is conveyed into the lower region.

19 Claims, 5 Drawing Sheets

(56) References Cited

U.S. PATENT DOCUMENTS

| | | | | | |
|---|---|---|---|---|---|
| 4,872,270 | A * | 10/1989 | Fronheiser | F26B 3/00 | 34/421 |
| 5,657,555 | A * | 8/1997 | Milojevic | F26B 3/283 | 34/271 |
| 5,881,476 | A * | 3/1999 | Strobush | F26B 13/10 | 34/210 |
| 5,921,002 | A * | 7/1999 | Scheufler | B01D 46/00 | 34/269 |
| 7,011,869 | B2 * | 3/2006 | Emch | B05D 3/0209 | 427/202 |
| 7,658,017 | B1 * | 2/2010 | Laviolette | F26B 5/042 | 34/403 |
| 9,815,083 | B2 * | 11/2017 | Beaudry | B65D 88/121 | |
| 10,267,034 | B1 * | 4/2019 | Conboy | E04B 1/944 | |
| 10,267,562 | B2 * | 4/2019 | Natsume | B05C 9/14 | |
| 2006/0055091 | A1 | 3/2006 | Doll | | |
| 2018/0328663 | A1 * | 11/2018 | Inami | F26B 15/18 | |

FOREIGN PATENT DOCUMENTS

| | | | | | |
|---|---|---|---|---|---|
| CN | 204881088 | U | | 12/2015 | |
| CN | 108043682 | A | | 5/2018 | |
| EP | 3252409 | A1 | * | 12/2017 | B05C 9/14 |
| JP | H 04-246197 | A | | 9/1992 | |
| JP | H 04-367761 | A | | 12/1992 | |
| JP | H 05-277421 | A | | 10/1993 | |
| JP | H 11-197579 | A | | 7/1999 | |
| JP | 2001-310150 | A | | 11/2001 | |
| JP | 2011-025153 | A | | 2/2011 | |
| JP | 2018192392 | A | * | 12/2018 | F26B 15/18 |
| JP | 6484664 | B2 | * | 3/2019 | F26B 15/18 |
| WO | WO-2016120965 | A1 | * | 8/2016 | B05C 9/14 |

* cited by examiner

DRYING APPARATUS AND DRYING METHOD USING THE DRYING APPARATUS

CROSS-REFERENCE TO RELATED APPLICATIONS

The present application claims priority from Japanese Patent Application No. 2017-096157 filed on May 15, 2017, the entire contents of which are hereby incorporated by reference.

BACKGROUND

1. Technical Field

The present invention relates to a drying apparatus that dries a workpiece to which paint is applied and a drying method using the drying apparatus.

2. Related Art

Vehicles, such as automobiles, are generally formed by assembling metal members that constitute, for example, a vehicle body and resin members that constitute, for example, bumpers. In recent years, more and more resin members have been used to reduce vehicle weight.

Metal members and resin members are normally painted in different steps because they have different heat resistances. More specifically, the metal and resin members, which are workpieces to be painted, are separately subjected to cleaning, paint application, and paint drying processes, and then the painted metal and resin members are assembled in a trim assembly step.

Japanese Unexamined Patent Application Publication (JP-A) No. 2011-25153, for example, describes a painting method for a vehicle including a metal steel plate and a resin member. In this painting method, the metal steel plate is heated and dried (baked) by a first drying apparatus after paint is applied thereto. The resin member is heated and dried (baked) by a second drying apparatus, which is different from the first drying apparatus, after the same paint as the paint applied to the metal steel plate is applied thereto. The first and second drying apparatuses each have an individual heating device. The second drying apparatus dries the resin member at a heating temperature lower than that of the first drying apparatus.

According to the painting method described in JP-A No. 2011-25153, the same paint is applied to the metal steel plate and the resin member, so that the paint can be applied to different members in the same step. Thus, the painting step can be improved.

SUMMARY OF THE INVENTION

An aspect of the present invention provides a drying apparatus including a heating mechanism configured to heat an inside of a drying oven in which paint applied to a workpiece is dried. The inside of the drying oven is partitioned into an upper region and a lower region by a partition plate. The drying oven has an air passage that enables air to flow between the upper region and the lower region. A metal member to which paint is applied is conveyed into the upper region, and a resin member to which paint is applied is conveyed into the lower region.

DETAILED DESCRIPTION

In the following, a description is given of some examples of the technology with reference to the accompanying drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following examples which are not recited in a most-generic independent claim of the disclosure are optional and may be provided on an as-needed basis. The drawings are schematic and are not intended to be drawn to scale.

According to the painting method described in JP-A No. 2011-25153, the paint that can be used is limited because the paint needs to be applicable to both the metal steel plate and the resin member. Therefore, the paint for the metal steel plate and the resin member cannot be selected from many types of paint depending on the required finishing.

In the painting method according to the related art, the metal steel plate and the resin member need to be dried at different heating temperatures. Therefore, the metal steel plate and the resin member have their respective drying apparatuses, which each have an individual heating device. In other words, the metal steel plate and the resin member are conveyed to their respective drying apparatuses in different steps after the paint is applied thereto, and the temperatures of the metal steel plate and the resin member are managed by drying the paint in different steps. Accordingly, the painting cost is high and it is difficult to increase the manufacturing efficiency.

It is desirable to provide a drying apparatus capable of reducing the cost of painting a metal member and a resin member and facilitating the manufacturing steps, and a painting method using the drying apparatus.

First Example

Figure 1:
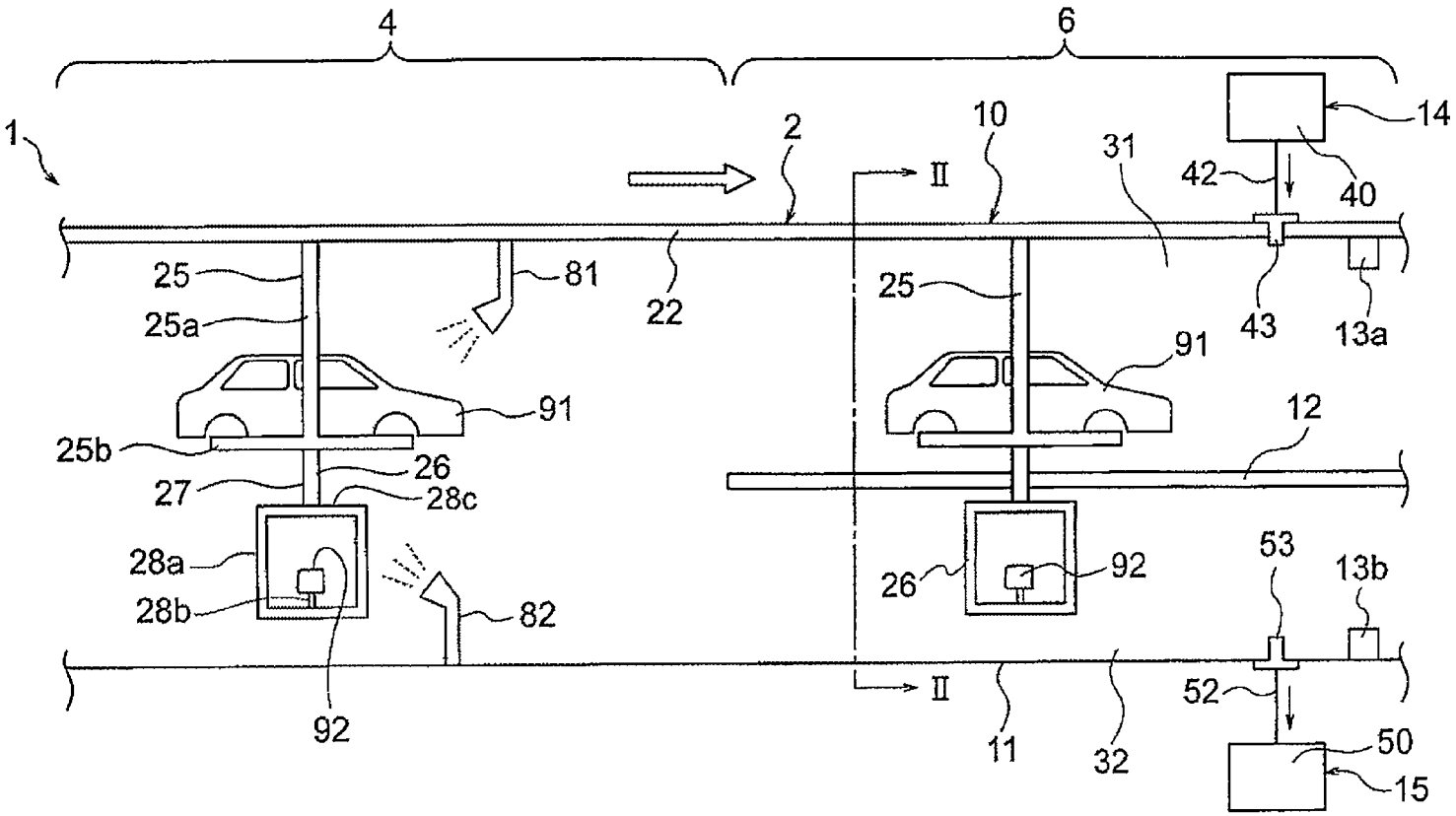
FIG. 1 illustrates the structure of a painting system including a drying apparatus according to a first example of the present invention.
Figure 2:
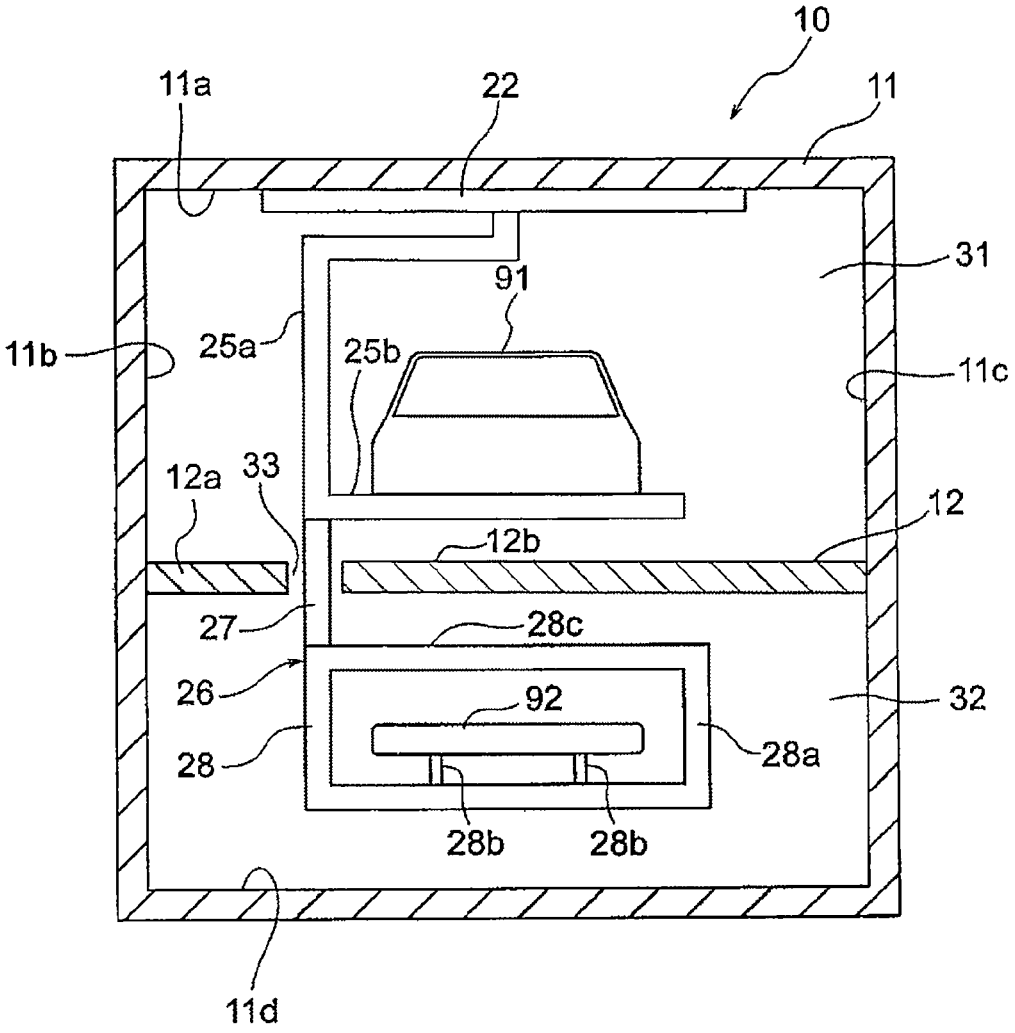
FIG. 2 is a sectional view of FIG. 1 taken along line II-II.

A painting system 1 including a drying apparatus 10 according to a first example of the present invention will now be described in detail. FIG. 1 illustrates the structure of the painting system 1 including the drying apparatus 10 according to the first example of the present invention. FIG. 2 is a sectional view of FIG. 1 taken along line II-II.

The painting system 1 applies paint to a surface of each of a metal member 91 and a resin member 92, which constitute a vehicle, such as an automobile, and then dries the paint by heating the paint. In this example, the metal member 91 is a body of an automobile, and the resin member 92 is a bumper of the automobile. The painting system 1 includes a conveyor line 2 that extends in a direction indicated by the white hollow arrow in FIG. 1. A painting zone 4, in which the paint is applied to the members, and a drying zone 6, in which the paint is dried, are provided along the conveyor line 2.

The metal member 91 and the resin member 92 are conveyed through each of the zones 4 and 6 by a conveying mechanism. The conveying mechanism includes a first conveying jig 25 that supports the metal member 91 in a suspended state, a second conveying jig 26 that supports the resin member 92 in a suspended state, and a conveyor 22 that moves the first conveying jig 25 and the second conveying jig 26 along the conveyor line 2. The conveyor 22 continuously or discontinuously extends along the conveyor line 2. In this example, the conveyor 22 continuously extends through upper parts of the painting zone 4 and the drying zone 6 so as to couple these zones 4 and 6.

The first conveying jig 25 includes a first support 25*a* and a first holder 25*b*. The first support 25*a* is rod-shaped and coupled to the conveyor 22 at the top end thereof. The first holder 25*b* is coupled to the bottom end of the first support 25*a*, and holds the automobile body, that is, the metal member 91. The first conveying jig 25 may instead hold the automobile body at both sides thereof in the width direction.

The second conveying jig 26 includes a second support 27 and a second holder 28. The second support 27 is rod-shaped and coupled to the first conveying jig 25 at the top end thereof. The second holder 28 is coupled to the bottom end of the second support 27 and holds the resin member 92. Referring to the side view of FIG. 1, in this example, the top end of the second support 27 is coupled to the bottom end of the first support 25*a* so that the first support 25*a* and the second support 27 extend along a straight line. When the metal member 91 and the resin member 92 are conveyed, the resin member 92 is directly below the metal member 91.

The second holder 28 includes a rectangular-parallelepiped-shaped frame 28*a*, a bottom plate that defines the bottom of the frame 28*a*, mounts 28*b* that project from the bottom plate, and a top plate 28*c* that covers the upper surface of the frame 28*a*. The resin member 92 is conveyed in the frame 28*a*, and the top plate 28*c* covers the entire upper surface of the resin member 92 when the resin member 92 is conveyed. Four peripheral sides of the frame 28*a* are open. The top plate 28*c* may constantly cover the upper surface of the frame 28*a*, or be capable of opening and exposing the upper surface of the frame 28*a*.

Referring to FIG. 1, painting devices 81 and 82 are disposed in a painting chamber that defines the painting zone 4. The painting devices 81 and 82 spray paint toward the metal member 91 and the resin member 92, respectively. The painting device 81 for metal and the painting device 82 for resin may discharge the same paint or different paints. In this example, different paints are used.

The drying apparatus 10 is installed in the drying zone 6. The drying apparatus 10 includes a drying oven 11, a partition plate 12, temperature sensors 13*a* and 13*b*, a drying mechanism 14, and an odor treatment mechanism 15.

As illustrated in FIG. 2, the drying oven 11 has a rectangular shape and includes a ceiling surface 11*a*, left and right side surfaces 11*b* and 11*c*, and a floor surface 11*d*. The conveyor 22, which extends from the painting zone 4, is disposed on the ceiling surface 11*a* of the drying oven 11. The inside of the drying oven 11 is vertically partitioned into an upper region 31 and a lower region 32 by the partition plate 12, which is flat plate-shaped. The upper region 31 and the lower region 32 respectively accommodate the temperature sensors 13*a* and 13*b*, which are capable of detecting the temperatures in the upper region 31 and the lower region 32, respectively.

The partition plate 12 may be any plate as long as the inside of the drying oven 11 can be vertically partitioned, and it is not necessary that the upper region 31 and the lower region 32 be separated from each other in a sealed state. The partition plate 12 may have a slit, a through hole, or the like that enables air to flow between the upper region 31 and the lower region 32. In this example, as illustrated in FIG. 2, the partition plate 12 includes plate members 12*a* and 12*b* arranged in a width direction (direction perpendicular to the vertical direction and the conveying direction) so as to be parallel to the floor surface 11*d*. Each of the plate members 12*a* and 12*b* extends in the conveying direction of the conveyor line 2, and a gap 33 is provided between the plate members 12*a* and 12*b*, which are adjacent to each other.

The gap 33 serves as an air passage that enables air to flow between the upper region 31 and the lower region 32. In the drying oven 11, the second support 27 of the second conveying jig 26 conveys the resin member 92 along the conveyor line 2 in such a manner that the second support 27 extends from the upper region 31 to the lower region 32 through the gap 33 in the partition plate 12.

The drying mechanism 14 heats the inside of the drying oven 11 to dry the paints. In this example, the drying mechanism 14 includes a heating device 40 and a duct 42 through which the heating device 40 and the drying oven 11 communicate. The duct 42 has an air outlet 43 in the upper region 31 of the drying oven 11. The drying mechanism 14 blows hot air heated by the heating device 40 into the upper region 31 of the drying oven 11 through the duct 42, thereby directly heating the upper region 31. The heating device 40 and the temperature sensors 13*a* and 13*b* are coupled to a controller (not illustrated), so that the operation of the heating device 40 can be controlled based on the temperatures detected by the temperature sensors 13*a* and 13*b*.

The odor treatment mechanism 15 performs odor treatment for removing odor from air discharged from the lower region 32, and discharges the treated air out of the drying oven 11. The odor treatment mechanism 15 includes a duct 52 and an odor treatment device 50. The duct 52 has an air inlet 53 in a wall surface of the lower region 32 of the drying oven 11, and serves as an air channel for the air discharged from the lower region 32. The odor treatment device 50 is coupled to the downstream end of the duct 52.

A painting method for painting the metal member 91 and the resin member 92 by using the above-described painting system 1 will now be described.

As illustrated in FIG. 1, the metal member 91 and the resin member 92, which are respectively suspended by the first conveying jig 25 and the second conveying jig 26, are conveyed together to the painting zone 4 by the conveyor 22. In the painting zone 4, the paints are applied to the surfaces of the metal member 91 and the resin member 92 by the painting devices 81 and 82, respectively (paint applying step).

The metal member 91 and the resin member 92 to which the paints have been applied are respectively conveyed to the upper region 31 and the lower region 32 of the drying oven 11, which defines the drying zone 6, by the conveyor 22.

In the drying oven 11, the upper region 31 is directly heated by the hot air blown out of the drying mechanism 14. The lower region 32 is indirectly heated by hot air blown thereinto through the gap 33 in the partition plate 12. At this time, high-temperature air flows into the upper region 31 of the drying oven 11 and low-temperature air flows into the lower region 32 of the drying oven 11 because of the difference in specific gravity of the air due to the temperature difference. Accordingly, the temperature in the upper region 31 is maintained higher than that in the lower region 32. As a result, the metal member 91 is heated and dried at a high temperature, and the resin member 92 is heated and dried at a temperature lower than the temperature at which the metal member 91 is heated and dried (drying step). In particular, since the drying mechanism 14 directly heats the upper region 31 and the lower region 32 is indirectly heated by the hot air blown thereinto from the upper region 31, the temperature in the upper region 31 can be reliably maintained higher than that in the lower region 32.

In general, the curing temperature of the paint applied to the resin member 92 is set lower than that of the paint applied to the metal member 91 to prevent deformation and quality degradation. In the drying apparatus 10 of this example, the metal member 91 and the resin member 92 can be dried at different heating temperatures by using a simple structure in which the inside of the drying oven 11 is vertically partitioned by the partition plate 12. Therefore, the painting cost is significantly lower than that in the case where the metal member 91 and the resin member 92 are separately painted as in the related art. In addition, the metal member 91 and the resin member 92 can be simultaneously subjected not only to the paint applying process but also to the drying process by using the same conveying mechanism. Accordingly, the manufacturing steps can be facilitated and the manufacturing efficiency can be increased.

In this example, the metal member 91 and the resin member 92 are conveyed along the same conveyor line 2 in both the paint applying step and the drying step. However, the metal member 91 and the resin member 92 may instead be conveyed along different conveyor lines when they are painted, and then be carried to the same drying apparatus 10.

In the drying step, air discharged from the lower region 32 is discharged out of the drying apparatus 10 after being subjected to odor treatment by the odor treatment mechanism 15. Since hot air is supplied from the upper region 31 to the lower region 32 through the gap 33, the odor concentration is higher in the lower region 32 than in the upper region 31. In addition, the amount of odor is smaller than that in the case where an individual odor treatment device is provided for each of the metal member 91 and the resin member 92. Thus, the treatment efficiency of the odor treatment device 50 can be increased by increasing the odor concentration and reducing the amount of odor.

In the above-described painting system 1, the paint applying step and the drying step are performed while the metal member 91 and the resin member 92 are conveyed together at the same conveying speed by the first and second conveying jigs 25 and 26, which are permanently affixed together. Therefore, the manufacturing steps can be facilitated by subjecting the metal member 91 and the resin member 92 to the paint applying step and the drying step together, and the size of the drying apparatus can be reduced. Furthermore, since the upper surface of the resin member 92 is covered by the top plate 28*c*, the paint applied to the metal member 91 is prevented from falling from the upper region 31 into the lower region 32 through the gap 33 in the partition plate 12 and adhering to the resin member 92 in the paint applying step and the drying step.

Figure 3:
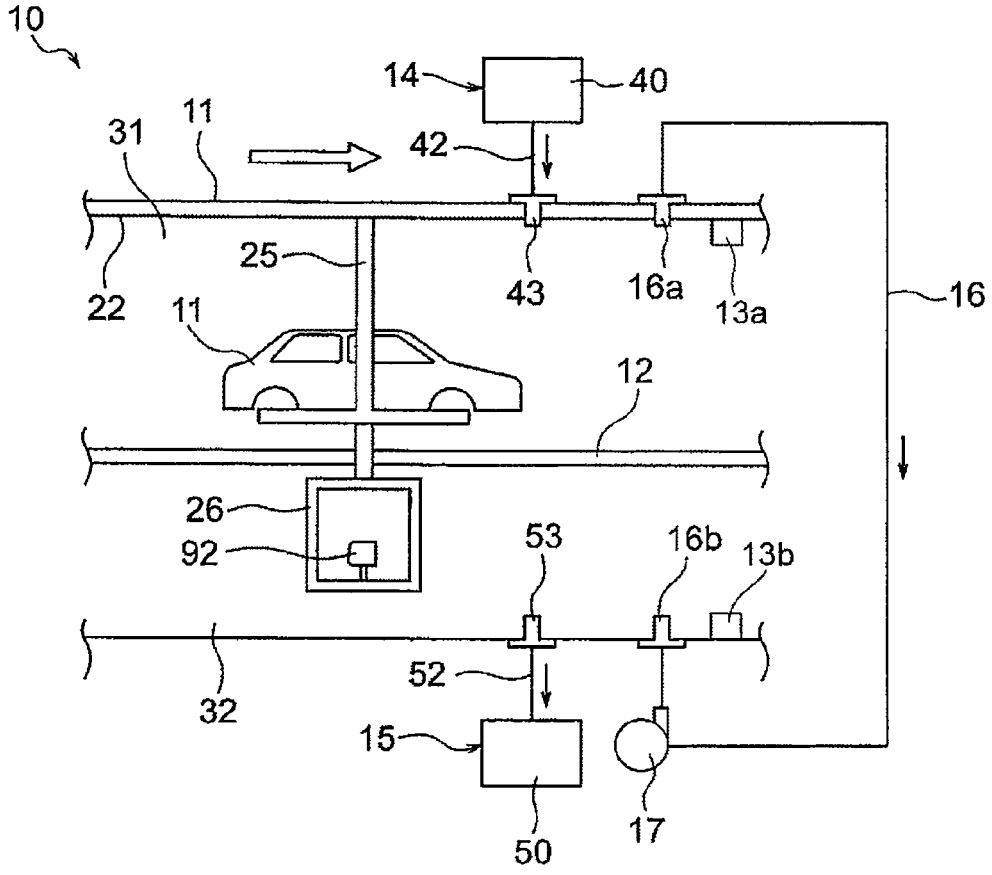
FIG. 3 illustrates the structure of a drying apparatus according to a modification.

FIG. 3 illustrates the structure of a drying apparatus 10 according to a modification. In FIG. 3, components similar to those in the example illustrated in FIGS. 1 and 2 are denoted by the same reference numerals, and description thereof is thus omitted.

In the modification, the drying apparatus 10 additionally includes an air duct 16 through which the upper region 31 and the lower region 32 communicate and which defines an air passage between the upper region 31 and the lower region 32. The air duct 16 has a blower 17, and an air inlet 16*a* and an air outlet 16*b* of the air duct 16 are respectively disposed in the upper region 31 and the lower region 32.

In the drying apparatus 10 according to the modification, hot air in the upper region 31 flows into the lower region 32 through the gap 33 in the partition plate 12, and is also guided to the lower region 32 through the air duct 19. Accordingly, the hot air blown into the upper region 31 by the drying mechanism 14 is more effectively guided to the lower region 32.

In the drawings, the air outlet 43 of the drying mechanism 14 and the air inlet 16*a* of the air duct 16 are disposed on the ceiling surface 11*a* in the upper region 31, and the air inlet 53 of the odor treatment mechanism 15 and the air outlet 16*b* of the air duct 16 are disposed on the floor surface 11*d* in the lower region 32 to facilitate understanding of the structure. However, the arrangement of these components is not limited to the arrangement illustrated in the drawings. For instance, the air inlet 16*a* of the air duct 16 may instead be disposed at a position below the air outlet 43 of the drying mechanism 14 in the upper region 31.

Second Example

Figure 4:
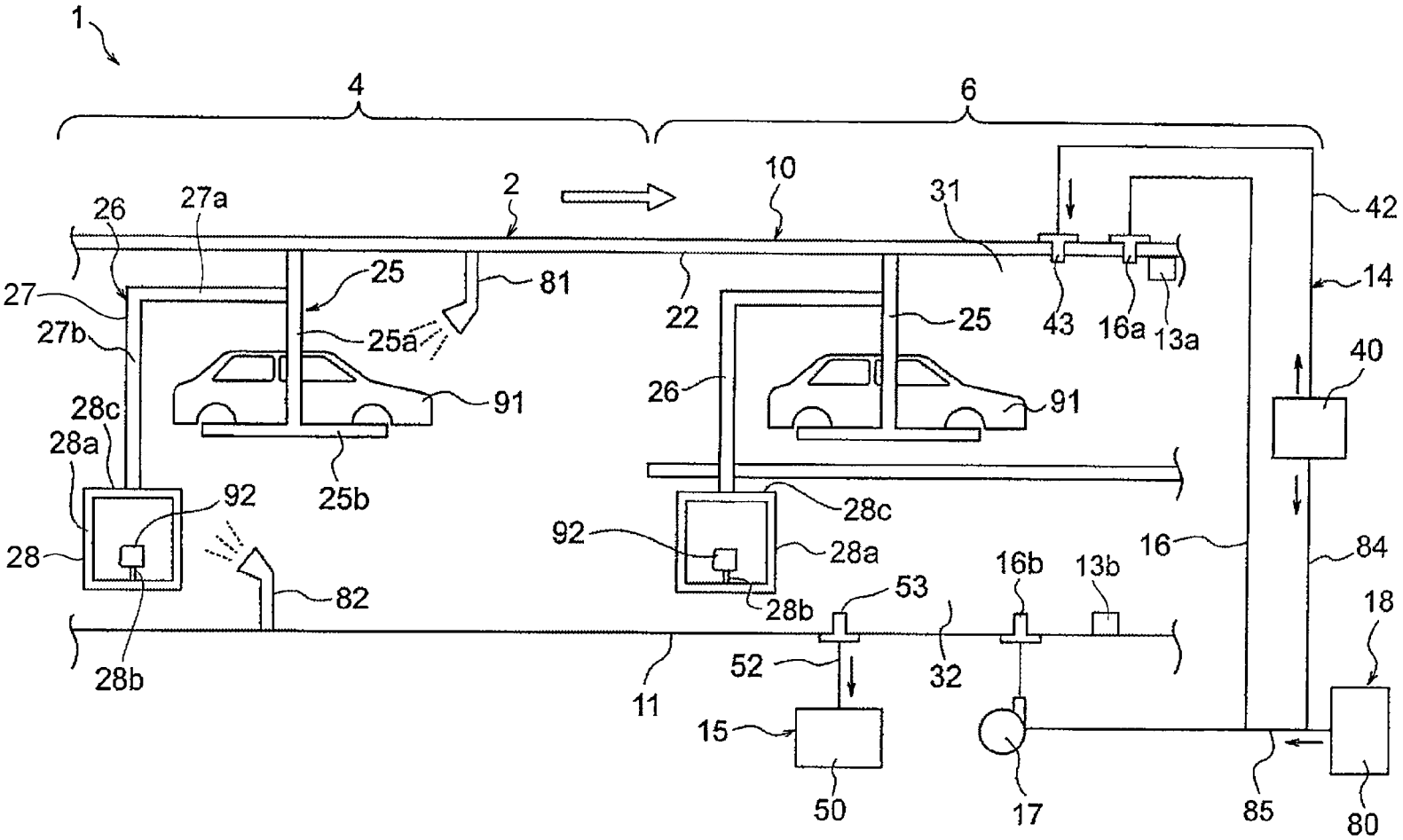
FIG. 4 illustrates the structure of a painting system including a drying apparatus according to a second example.

FIG. 4 illustrates the structure of a painting system 1 including a drying apparatus 10 according to a second example. In FIG. 4, components similar to those in the above-described example and modification are denoted by the same reference numerals, and description thereof is thus omitted.

In this example, the drying apparatus 10 additionally includes a temperature adjusting mechanism 18. The temperature adjusting mechanism 18 is coupled to the air duct 16, and adjusts the temperature of the air supplied to the lower region 32. The temperature adjusting mechanism 18 shares the heating device 40 with the drying mechanism 14, and includes a duct 84 that guides hot air from the heating device 40 toward the lower region 32, a cooling device 80, and a duct 85 that guides cold air from the cooling device 80 toward the lower region 32. In the illustrated configuration, the downstream end of the duct 84 that extends from the heating device 40 is coupled to the duct 85 that extends from the cooling device 80, and the downstream end of the duct 85 is coupled to the air duct 16. The air whose temperature is adjusted by the heating device 40 and the cooling device 80 flows through the air duct 16 and is blown into the lower region 32 through the air outlet 16*b*.

The heating device 40, the cooling device 80, and the temperature sensors 13*a* and 13*b* are coupled a controller (not illustrated), and the operations of the heating device 40 and the cooling device 80 are controlled based on the temperatures detected by the temperature sensors 13*a* and 13*b*. For instance, the heating temperature of the heating device 40 may be increased when the temperature detected by the temperature sensor 13*a* in the upper region 31 is lower than a preset target drying temperature for the metal member 91. Also, the cooling temperature of the cooling device 80 may be reduced to reduce the temperature of the air blown out of the air duct 16 when the temperature detected by the temperature sensor 13*b* in the lower region 32 is higher than a preset target drying temperature for the resin member 92. Thus, the temperatures in the upper region 31 and the lower region 32 can be set to heating temperatures suitable for drying the metal member 91 and the resin member 92, respectively.

The conveying mechanism of this example is configured such that the resin member 92 is suspended by the second conveying jig 26 at a position behind the metal member 91 suspended by the first conveying jig 25 in the conveying direction. In the illustrated configuration, the second support 27 of the second conveying jig 26 has the shape of an L-shaped rod. The second support 27 includes a horizontal member 27*a* that extends in a direction opposite to the conveying direction from one end thereof that is coupled to an upper part of the first support 25*a*, and a vertical member 27*b* that extends downward from the back end of the horizontal member 27*a*. The second holder 28 of the second conveying jig 26 is attached to the bottom end of the vertical member 27*b*.

In the drying apparatus 10 of this example, the lower region 32 can be heated by guiding air from the upper region 31 to the lower region 32 through the air duct 16. In addition, since the air duct 16 is coupled to the temperature adjusting mechanism 18, the temperature of the air blown into the lower region 32 from the air duct 16 can be adjusted to a temperature suitable for heating the resin member 92. Furthermore, since the heating device 40 is shared by the drying mechanism 14 and the temperature adjusting mechanism 18, the size of the drying apparatus 10 and the energy consumption can be reduced.

The resin member 92 is not disposed directly below the metal member 91 but is disposed behind the metal member 91 in the conveying direction along the conveyor line 2. Therefore, the paint applied to the metal member 91 can be more reliably prevented from adhering to the resin member 91. Although not illustrated, the conveying jigs 25 and 26 may instead be configured so that the resin member 92 is in front of the metal member 91 in the conveying direction.

Third Example

Figure 5:
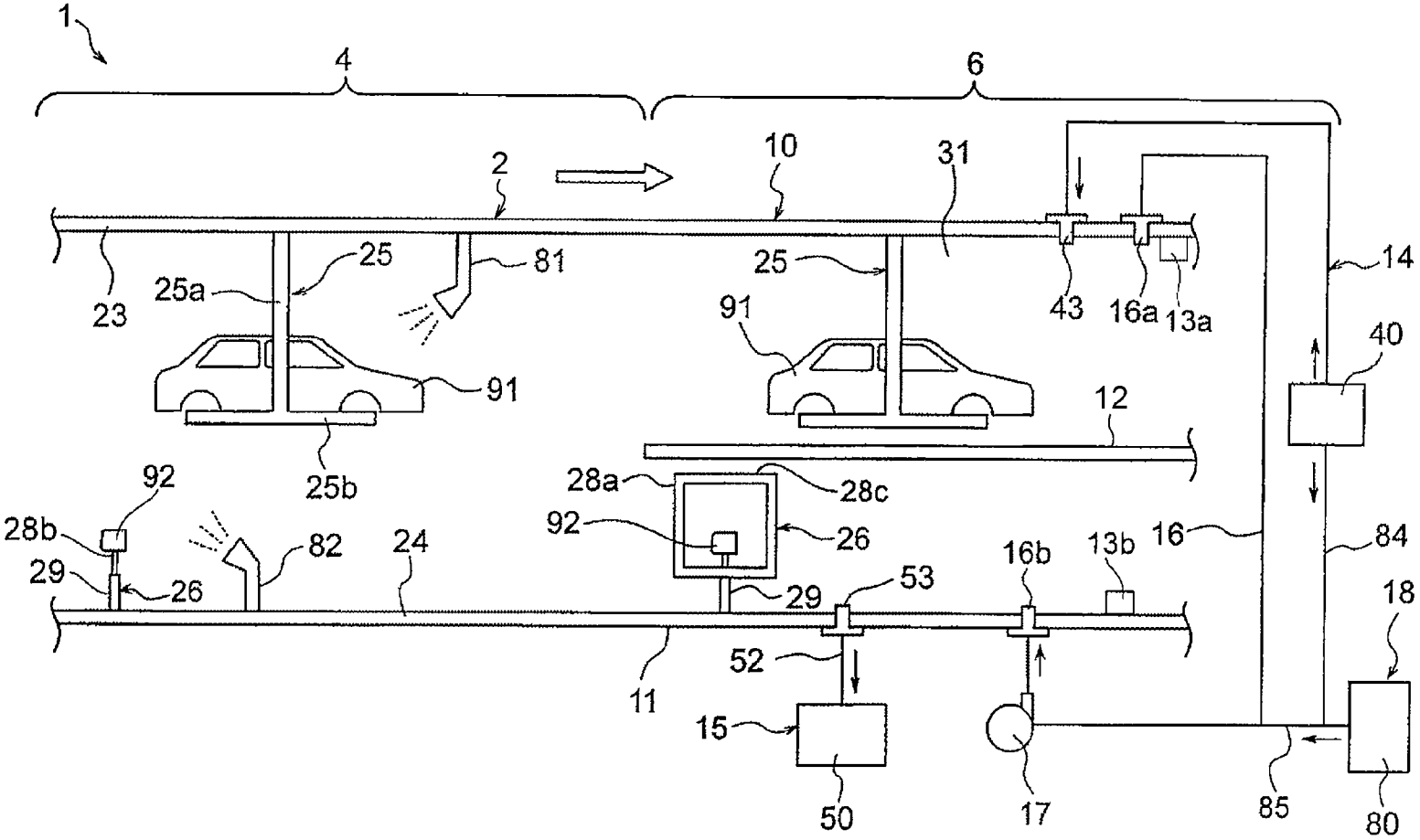
FIG. 5 illustrates the structure of a painting system including a drying apparatus according to a third example.

FIG. 5 illustrates the structure of a painting system 1 including a drying apparatus 10 according to a third example. In FIG. 5, components similar to those in the above-described examples and modification are denoted by the same reference numerals, and description thereof is thus omitted.

In this example, the conveying mechanism includes a first conveyor 23 that conveys the first conveying jig 25 along the conveyor line 2 and a second conveyor 24 that conveys the second conveying jig 26 along the conveyor line 2. The drying oven 11 is partitioned into the upper region 31 and the lower region 32 in a substantially sealed state by a single partition plate 12. The structure of the first conveyor 23 is similar to that of the conveyor 22 according to the first example, and description thereof is thus omitted. The second conveyor 24 is disposed below the first conveyor 23 and extends along the floor surface 11*d* of the drying oven 11 of the drying apparatus 10.

The second conveying jig 26, which is separate from the first conveying jig 25, is a carriage conveying jig including a carriage body 29 coupled with the second conveyor 24 and mounts 28*b* that are attached to the carriage body 29 and on which the resin member 92 is placed. The top plate 28*c* that covers the entire upper surface of the resin member 92 is attached to the carriage body 29 of the second conveying jig 26 after paint is applied to the resin member 92. In the illustrated configuration, the rectangular-parallelepiped-shaped frame 28*a*, which includes the top plate 28*c*, is attached to the carriage body 29. Similar to the first example, the first conveying jig 25 is a suspending conveying jig.

The first conveying jig 25 and the second conveying jig 26 are displaced from each other in the conveying direction so that the metal member 91 and the resin member 92 do not overlap in the vertical direction when the metal member 91 and the resin member 92 are conveyed.

In the drying apparatus 10 of this example, the upper region 31 and the lower region 32 are separated from each other by the partition plate 12 in a substantially sealed state. Therefore, the partition plate 12 has no gaps through which hot air in the upper region 31 flows into the lower region 32, and the heating temperature in the lower region 32 can be easily adjusted by the temperature adjusting mechanism 18.

Since the first conveying jig 25 and the second conveying jig 26 are separate components, conveyance time periods of the resin member 92 and the metal member 91 can be controlled so that the resin member 92 stays in the drying oven 11 shorter or longer than the metal member 91 does. Thus, the members 91 and 92 can be dried by heating them for more appropriate time periods.

The present invention is not limited to the above-described examples and modifications, and various changes are possible without departing from the spirit of the invention. For instance, the second conveying jig 26 may be configured to convey the resin member 92 along the conveyor line 2 in a suspended state by being moved by the conveyor 22 together with the first conveying jig 25 while being separate from the first conveying jig 25. This second conveying jig 26 holds the resin member 92 below the metal member 91 at a position in front of or behind the first conveying jig 25 in the conveying direction.

The invention claimed is:

1. A drying apparatus comprising:

a heating mechanism configured to heat an inside of a drying oven in which paint applied to a workpiece is dried; and partition members arranged in a width direction of the drying apparatus with a gap between the partition members that divide the inside of the drying over into an upper region and a lower region, wherein the drying oven includes an air passage that enables air to flow between the upper region and the lower region, and wherein a metal member to which paint is applied is conveyed into the upper region, and a resin member to which paint is applied is conveyed into the lower region.

2. The drying apparatus according to claim 1, wherein the heating mechanism is configured to heat the upper region.

3. The drying apparatus according to claim 2, further comprising:

an air duct that defines the air passage and is capable of supplying air from the upper region to the lower region.

4. The drying apparatus according to claim 3, further comprising:

a temperature adjusting mechanism coupled to the air duct and configured to adjust a temperature of the air supplied to the lower region.

5. The drying apparatus according to claim 3, further comprising:

an odor treatment mechanism configured to remove odor from air discharged from the lower region.

6. The drying apparatus according to claim 4, further comprising:

an odor treatment mechanism configured to remove odor from air discharged from the lower region.

7. The drying apparatus according to claim 1, further comprising:

a conveying mechanism configured to convey the metal member and the resin member together in the drying oven, wherein the conveying mechanism comprises a first conveying jig configured to suspend the metal member, and a second conveying jig configured to suspend the resin member, and wherein the second conveying jig is coupled to the first conveying jig at one end of the second conveying jig and extends from the upper region to the lower region through the partition plate.

8. The drying apparatus according to claim 2, further comprising:

a conveying mechanism configured to convey the metal member and the resin member together in the drying oven, wherein the conveying mechanism comprises a first conveying jig configured to suspend the metal member, and a second conveying jig configured to suspend the resin member, and wherein the second conveying jig is coupled to the first conveying jig at one end of the second conveying jig and extends from the upper region to the lower region through the partition plate.

9. The drying apparatus according to claim 3, further comprising:

a conveying mechanism configured to convey the metal member and the resin member together in the drying oven, wherein the conveying mechanism comprises a first conveying jig configured to suspend the metal member, and a second conveying jig configured to suspend the resin member, and wherein the second conveying jig is coupled to the first conveying jig at one end of the second conveying jig and extends from the upper region to the lower region through the partition plate.

10. The drying apparatus according to claim 4, further comprising:

a conveying mechanism configured to convey the metal member and the resin member together in the drying oven, wherein the conveying mechanism comprises a first conveying jig configured to suspend the metal member, and a second conveying jig configured to suspend the resin member, and wherein the second conveying jig is coupled to the first conveying jig at one end of the second conveying jig and extends from the upper region to the lower region through the partition plate.

11. The drying apparatus according to claim 7, wherein the second conveying jig comprises a top plate configured to cover an upper surface of the resin member.

12. The drying apparatus according to claim 8, wherein the second conveying jig comprises a top plate configured to cover an upper surface of the resin member.

13. The drying apparatus according to claim 9, wherein the second conveying jig comprises a top plate configured to cover an upper surface of the resin member.

14. The drying apparatus according to claim 10, wherein the second conveying jig comprises a top plate configured to cover an upper surface of the resin member.

15. A drying method for drying paint using the drying apparatus that includes a heating mechanism configured to heat an inside of a drying oven in which paint applied to a workpiece is dried and partition members arranged in a width direction of the drying apparatus with a gap between the partition members that divide the inside of the drying over into an upper region and a lower region, where the drying oven includes an air passage that enables air to flow between the upper region and the lower region, and where a metal member to which paint is applied is conveyed into the upper region, and a resin member to which paint is applied is conveyed into the lower region, the method comprising:

drying the metal member and the resin member by conveying the metal member and the resin member at equal conveying speed in the drying oven.

16. The method of claim 15, further comprising heating the upper region via the heating mechanism.

17. The method of claim 16, wherein an air duct defines the air passage and is capable of supplying air from the upper region to the lower region.

18. The method of claim 17, adjusting a temperature of the air supplied to the lower region.

19. A drying apparatus comprising:

a drying oven that has a shape of a cuboid extending along a conveyor line that conveys a painted workpiece, the cuboid including a ceiling surface, left and right side surfaces in contact with the ceiling surface and a floor surface in contact with the left and right side surfaces;

a partition that divides the drying oven into an upper region including the ceiling surface and a lower region including the floor surface, the partition having an air passage that pass through the partition from the upper region to the lower region and that extend in a conveying direction of the painted workpiece; and a heater configured to provide the upper region with hot air through a duct that connects the heater to the upper region, wherein, a first jig configured to hold, in the upper region, a metal member to which paint is applied and a second jig configured to hold, in the lower region, a resin member to which paint is applied are connected through the air passage and are conveyed along the air passage in the conveying direction of the painted workpiece, and wherein the first jig in the upper region is directly heated by a hot air provided by the heater, the second jig in the lower region is indirectly heated with a temperature lower than the upper region by a hot air provided from the upper region through the air passage.

* * * * *